United States Patent [19]

Bieri et al.

[11] Patent Number: 4,459,971

[45] Date of Patent: Jul. 17, 1984

[54] SUPPORT AND ORGANIZER FOR COMPONENTS OF SOLAR HEATING SYSTEMS AND THE LIKE

[75] Inventors: Jurg H. Bieri; Thomas M. Ingraham, both of El Cerrito, Calif.

[73] Assignee: Heliodyne, Inc., Richmond, Calif.

[21] Appl. No.: 394,510

[22] Filed: Jul. 2, 1982

[51] Int. Cl.[3] ..... F24J 3/02; F16L 3/00

[52] U.S. Cl. ..... 126/417; 126/437; 285/61; 137/343

[58] Field of Search ..... 126/450, 417, 418, 437; 285/61, 64; 137/343, 356; 248/49, 56

[56] References Cited

U.S. PATENT DOCUMENTS 4,210,125 7/1980 Fender ..... 126/437

4,257,479 3/1981 Newton ..... 126/437

*Primary Examiner*—Samuel Scott

*Assistant Examiner*—G. Anderson

*Attorney, Agent, or Firm*—Manfred M. Warren; Robert B. Chickering; Glen R. Grunewald

[57] ABSTRACT

An apparatus is disclosed for the support and organization in a compact and efficient manner of the various components required for a solar heating system. Of importance are a pair of elongated upstanding members mounted in spaced apart relation for positioning therebetween of a pair of superimposed pumps and unitarily mounted electric motor drives therefor. The upstanding members are formed with internal passages and ports for the close and compact support of the balance of the components required for the solar loop circuit and a heat exchanger heated fluid such as potable water or spa water or various combinations of heated fluids.

6 Claims, 9 Drawing Figures

SUPPORT AND ORGANIZER FOR COMPONENTS OF SOLAR HEATING SYSTEMS AND THE LIKE

BACKGROUND OF THE INVENTION

The invention relates to solar heating systems and the like where a heat source, such as a solar collector, is connected, typically by a heat exchanger, to a storage tank which may inturn supply water at an elevated temperature to a potable water heater or system, spa, etc. Such systems most commonly include a number of components such as pumps, valves, heat exchangers, expansion tank, pressure relief valve, pressure gauge, etc., which are variously connected in configurations providing different type systems including closed or open loops with single and multiple loads, drainback with single or multiple loads etc. Generally the system may be characterized as a configuration of components for transferring heat from a solar collector to storage while protecting the solar collector from freeze damage or fouling. In a closed loop system, one or more solar collectors are connected in a circuit with a pump and a heat exchanger containing a non-freezing fluid thereby protecting the collectors against freezing. Heat is typically transferred to a potable water circuit through the heat exchanger. Two pumps are normally required, one for the closed loop fluid and one for the potable water circuit. In a drainback system, water is circulated through the solar collector and freeze protection is provided by having a sump tank to which water can "drainback" whenever the collector loop pump is not operating. A heat exchanger is still required to transfer heat from the non-pressurized water in the collector circuit to the pressurized potable water circuit. Again two pumps are required. In a draindown system, potable water is typically pumped directly through the solar collector, and an automatic valve drains the collector whenever freezing conditions are sensed at the collector. There is also a recirculation system which recirculates warm water through the solar collectors to provide freeze protection whenever freezing conditions are sensed at the collectors.

After the type of system is determined, the installer will acquire all of the necessary components and proceed to lay out the parts within the space available and to complete the mounting, supporting and connecting of the parts using such structural mounting and plumbing parts as may be available. Frequently, substantial ingenuity and considerable work is required to complete the desired operating system within the space and mounting constrictions which may obtain; and sometimes rather gross, relatively costly and inefficient installations result.

SUMMARY OF THE INVENTION

The device of the present invention is designed to greatly assist the installer in the support and the organization of the components of the solar heating system with all of the parts most easily and conveniently connected in closely coupled relation providing a very compact and efficiently operating system with substantial saving of installation labor and use of materials.

Another object and feature of the present invention is to provide a support and organizer for the components which will provide flexibility for connection of the parts to provide any one of the systems above described and to allow for different spacial configurations to meet the needs of the particular installations.

A further object of the present invention is to provide a device of the character described which will provide superior mechanical strength for supporting the various parts and to absorb vibrations inherent in the operation of the system; and to afford easy removal of parts required to be removed for a periodic maintenance such as the heat exchanger, pumps and controls without disturbing or requiring the dismantling of other parts.

Still another object of the present invention is to provide a support and organizer for components of solar heating systems and the like which will accommodate different sizes, numbers and capacities of solar collectors thus facilitating the installation of different size solar heating systems, using one or a plurality of heat exchangers to provide one or simultaneous multiple outputs of heated fluids, e.g., potable water and spa water.

Still a further object of the present invention is to provide an apparatus of the character described which is especially designed to permit mounting directly upon the top of the storage tank with a resulting saving of space, reduction in heat losses due to shorter plumbing lines, and ease of removal of the module if necessary.

Another object of the present invention is to provide an apparatus of the character described which minimizes possible leak points in the system. Leaks are a persistent problem in site-built installations particularly with some non-aqueous fluids (oils and silicones). As a feature of the present apparatus the required threaded connections are reduced in both number and size. The main lines and connections to the heat exchangers use leak-proof unions. The vibration reducing feature of the apparatus contributes to reducing the potential leaks in threaded joints.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 2:
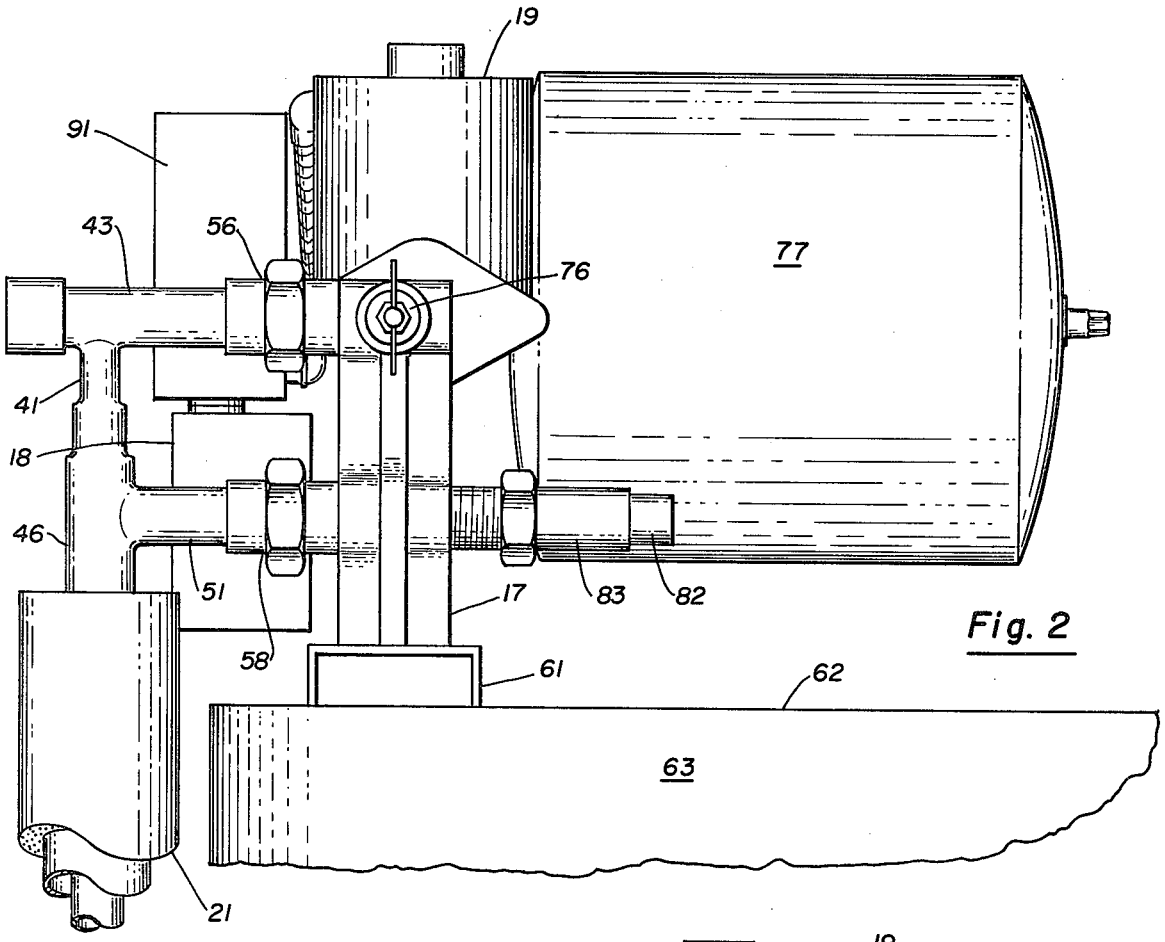
FIG. 2 is a fragmentary right-hand elevation on a somewhat enlarged scale of the apparatus illustrated in FIG. 1.
Figure 3:
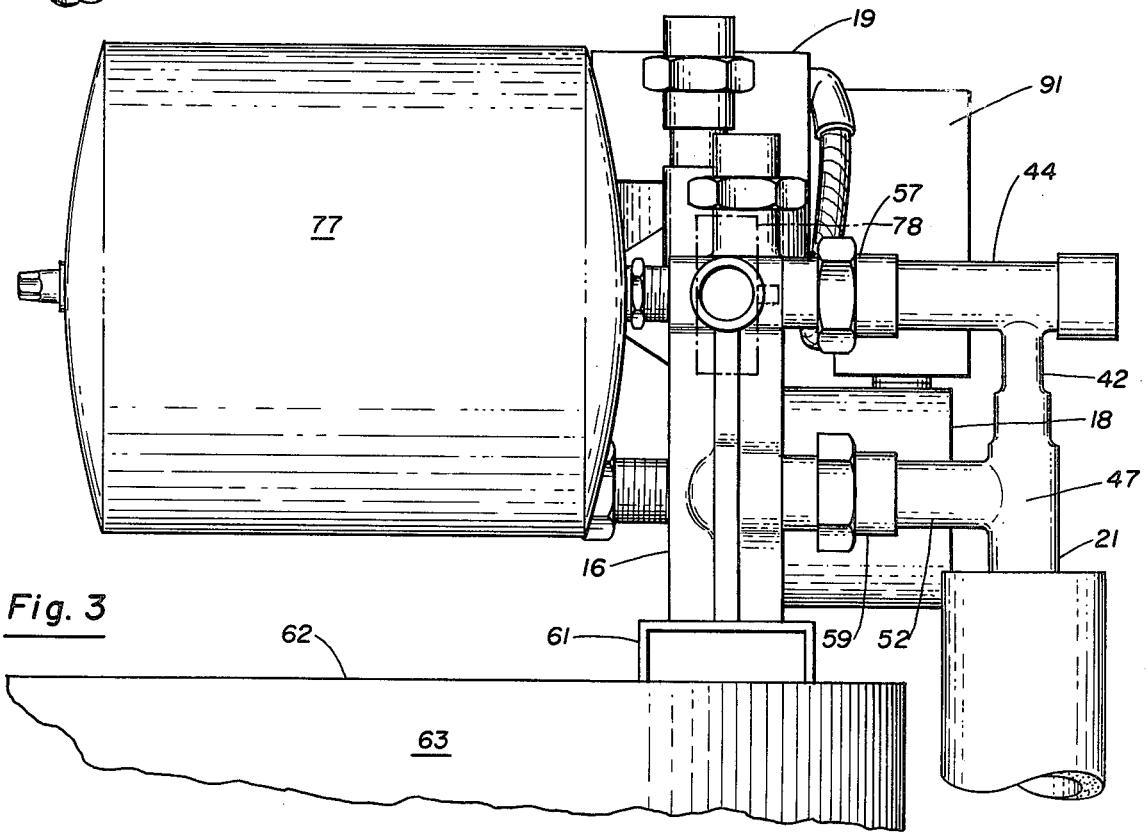
FIG. 3 is a left-hand elevation on a somewhat enlarged scale of the apparatus depicted in FIG. 1.

The apparatus of the present invention is designed to support, and to organize in a compact and efficient manner, the components of a solar heating system and the like, and comprises briefly: a pair of elongated members 16 and 17 mounted in substantially parallel relation and being spaced apart by a distance permitting positioning therebetween of a pair of superimposed pumps and unitarily mounted electric motor drives therefor 18 and 19. Members 16 and 17 are formed with internal passages, see FIGS. 5–9, terminating in ports adpated for connection to and supporting a heat exchanger (ports 22 and 23 in member 16 connected by passages 24 and 25, and ports 26 and 27 in member 17 connected by passages 28 and 29), passages 28 and 29 being adapted for connection to separate passages 31 and 32 provided by heat exchanger 21 for passage of a source of heated fluid, e.g., from a solar collector, and an exchanger heated fluid, e.g., potable hot water. Passages 31 and 32 are here contained in a pair of concentric heat exchanger tubes 33 and 34, see FIG. 1. The heat exchanger is wrapped with a layer of insulation material 36 and is bent into a U-shaped form having the normally free upper ends 41 and 42 of the inner tube 33 connected by fittings 43 and 44 to the upper ports 22 and 26 of the two members 16 and 17, and the normally free upper ends 46 and 47 of the outer tube 33 connected by fittings 51 and 52 to ports 23 and 27 of members 16 and 17. As an important feature of the present invention, the mounting of the heat exchanger is made readily demountable without disturbing the mounting or connection of the other parts, by including in fittings 43, 44, 51 and 52 a union, see unions 56, 57, 58 and 59, best seen in FIGS. 2 and 3.

As a further feature of the present invention, members 16 and 17 are preferably mounted in upstanding relation on a base 61 which is dimensioned for mounting directly upon the top 62 of a storage tank 63 so as to position heat exchanger 21 in a depending position at the front of the tank thus providing a convenient and compact support of the heat exchanger and other components carried by members 16 and 17. Passages 24 and 28 at the upper ends of members 16 and 17 also connect with ports 66, 67 and 68 (member 16), and ports 71 and 72 (member 17) so as to complete the solar collector fluid passage. In the present construction, port 67 is positioned at the top of member 16 for connection by conduit 73 to the intake of one or a battery of solar collectors (not shown). The collector output is connected by conduit 74 to the intake of pump 19 which is in turn connected to port 71 and to the collector passage of the heat exchanger via port 26. A pressure relief valve 76 may be conveniently connected to port 72 so as to place this valve in the collector circuit for automatically relieving any predetermined overpressure. Additionally an expansion tank 77 is connected to port 68 of member 16 to operate in parallel with the solar loop to control the pressure therein; and a pressure gauge 78 is connected to port 66 so as to constantly show the pressure in the collector loop circuit.

The exchanger heated fluid circuit includes ports 23 and 27 connected to the inside tube 31 of the heat exchanger; port 23 which is connected to the discharge side of pump 18; conduit 81 (FIG. 4) connected to the suction side of pump 18 and which is adapted for connection to a storage tank (not shown); and a conduit 82 which is connected to the storage tank and to a check valve 83 connected to port 84 of member 17 (see FIG. 8) and which is connected by passage 29 to port 27. Check valve 83 prevents reverse thermosyphoning, as for example at night when the collector may become cold.

Figure 1:
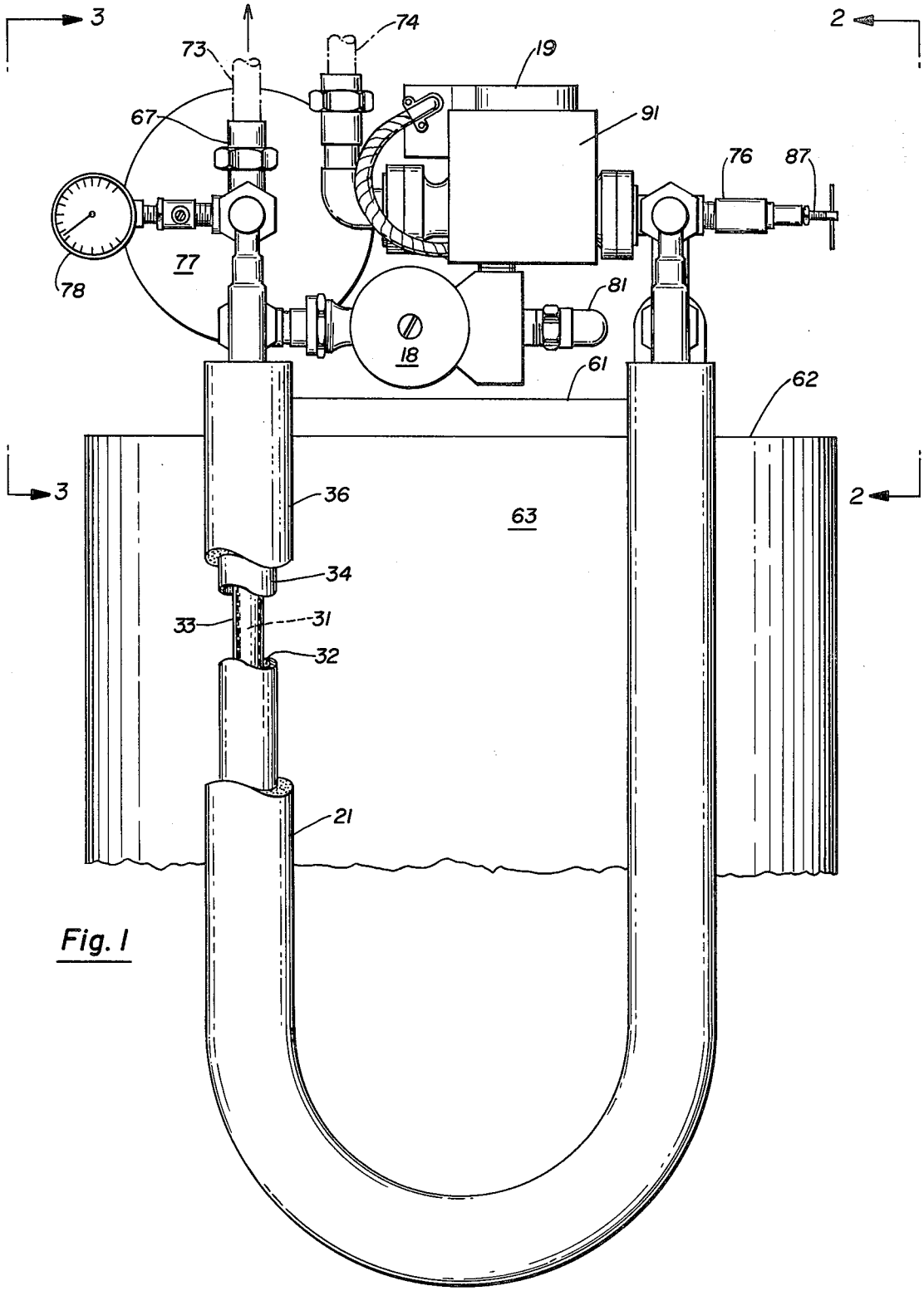
FIG. 1 is a front elevation of a support and organizer for components of a solar heating system and the like with certain of the components in mounted position thereof.
Figure 4:
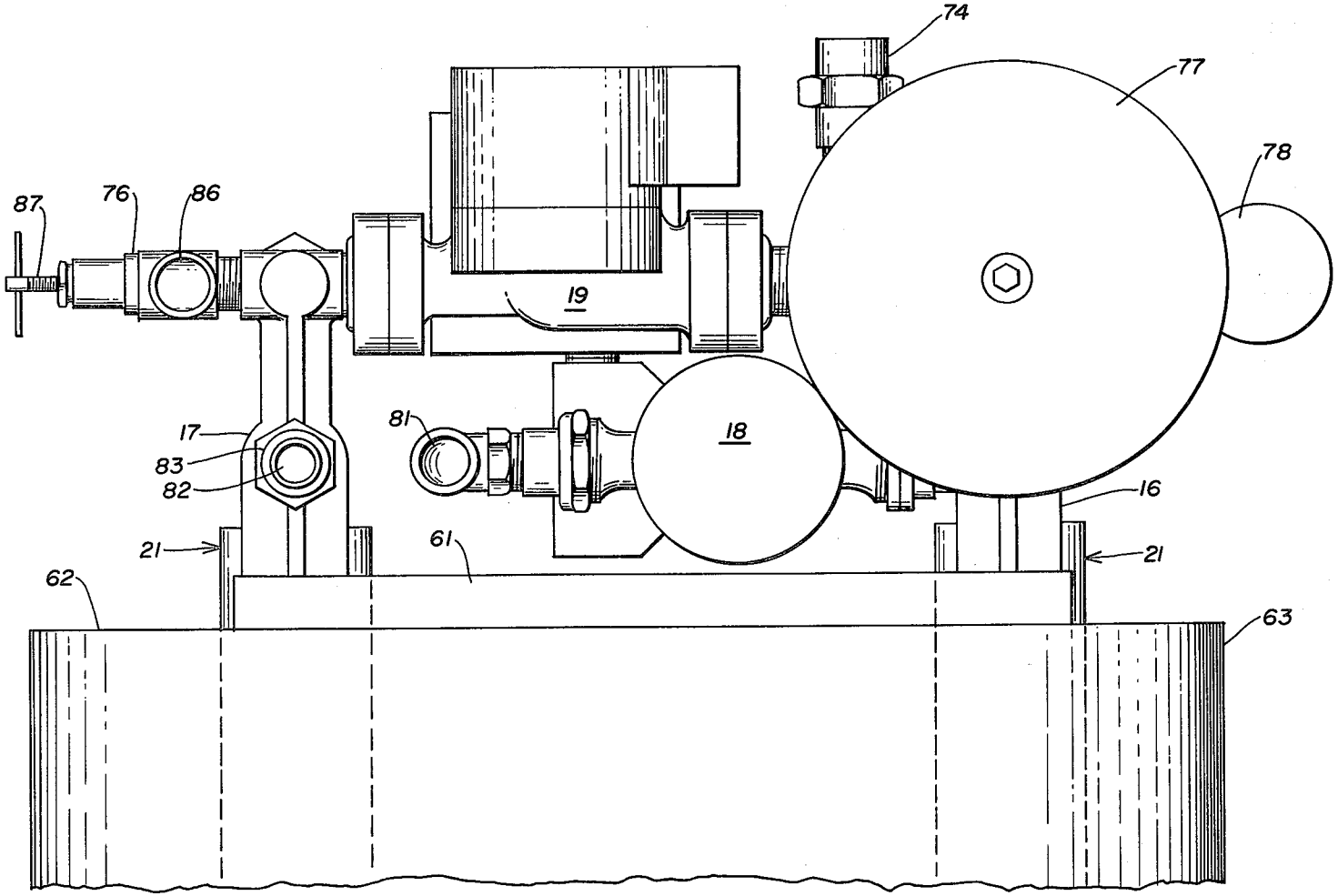
FIG. 4 is a rear elevation on an enlarged scale of the apparatus.
Figure 5:
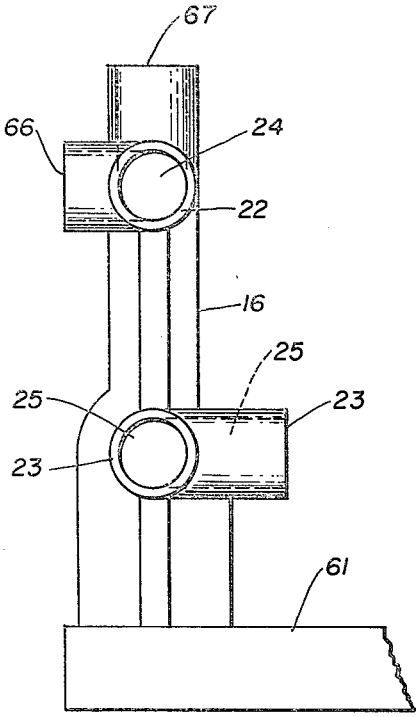
FIG. 5 is a front elevation of a portion of the apparatus.
Figure 6:
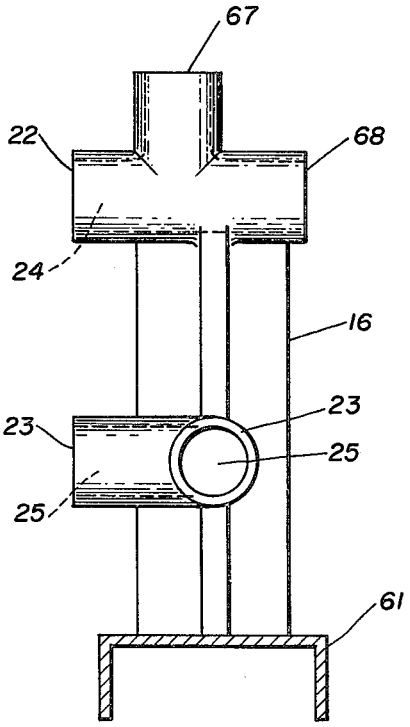
FIG. 6 is a right-hand elevation of the portion of the apparatus illustrated in FIG. 5.
Figure 8:
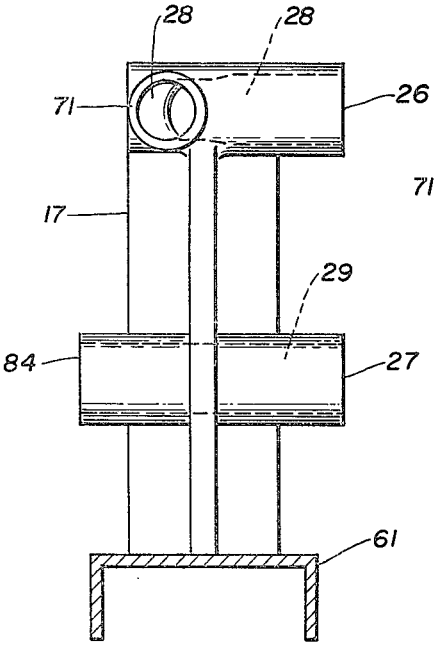
FIG. 8 is an end elevation of the portion of the apparatus shown in FIG. 7.
Figure 9:
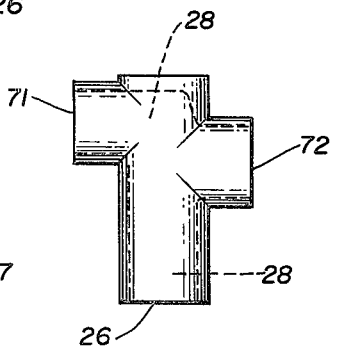
FIG. 9 is a top plan view of the portion of the apparatus shown in FIG. 7 as indicated by the lines 9—9 of FIG. 7.
Figure 7:
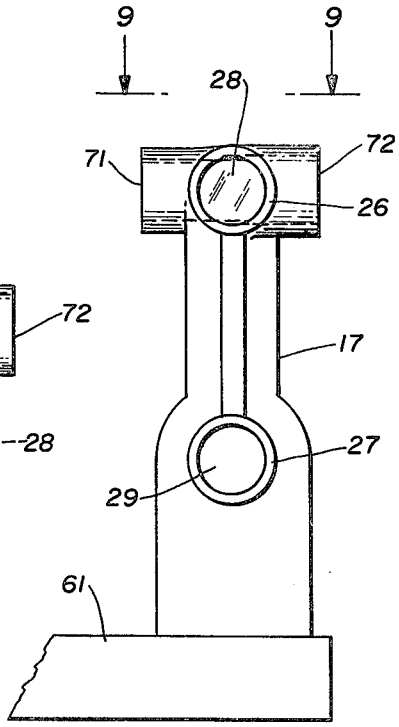
FIG. 7 is a front elevation of another portion of the apparatus.

As will be best observed from FIGS. 1 and 4, members 16 and 17 are spaced apart by a distance permitting the convenient mounting therebetween of pumps 18 and 19 and their electric motor drives, with the pump units superimposed one over the other within the space between the members. Moreover, the members and their pump connecting ports are structured to provide firm support for the pump units and to absorb the vibration normally present during the operation of the pumps. No extra support for the pump units is required other than the fittings connecting the member and pump ports, the fittings themselves carrying the mechanical load of the pump units. Of importance also, as above-noted, is the use of the unions in connecting the heat exchanger to the members thus permitting easy and ready periodic removal of the heat exchanger for cleaning, repair or replacement.

Port 72 also functions as a fill port for the heated source fluid circuit. This function may be conveniently combined with that of valve 76 by providing the latter with a port 86 which may be opened into port 72 and fluid passage 28 by backing off a pressure relief valve controlled by a manually adjustable handle 87. After filling of the heated source circuit, handle 87 may be operated to close off port 86 and set the relief valve to desired position.

The apparatus of the present invention is primarily designed for use with one or more solar collectors to provide the source of heated fluid. In certain areas and conditions of use, other sources of heated fluid may be available such as geysers, hot springs, industrial heated waste water, etc. The source heated fluid is of course kept entirely separate from the exchanger heated fluid which typically will be potable hot water. However, the apparatus is equally adaptable for heating spa water; and a heat exchanger can be provided with multiple separate passages so that spa water and potable water may, for example, be simultaneously heated.

Another feature of the present apparatus is supervision of an electric control box 91 in which may be mounted and prewired all of the electrical controls for the system, thus incorporating such controls as an integral part of the module. This is an important aspect since devices of the present character are usually installed by plumbing or mechanical contractors not versed in electrical wiring. In the present construction, the pre-wiring of the electrical controls permits the use of plugs so that the making of electrical connections in the field is greatly facilitated.

What is claimed is:

1. A support and organizer for components of solar heating systems and the like comprising:

a pair of elongated members mounted in substantially parallel relation and being spaced apart by a distance permitting positioning therebetween of a pair of superimposed pumps and unitarily mounted electric motor drives therefor and further permitting mounting directly upon the top of a storage tank;

said elongated members being formed with internal passages terminating in a first pair of ports and a second pair of ports adapted for connection to and supporting a heat exchanger, said heat exchanger having a tubular source heated fluid passage and a tubular exchange heated fluid passage, said exchange heated fluid passage being formed and positioned within said source heated fluid passage, each of said fluid passages terminating in ports, said first pair of ports of said elongated members being connected to said source heated fluid passage ports and said second pair of ports of said elongated members being connected to said exchanger heated fluid passage ports;

said elongated members being further formed with passages communicating with said internal passages and terminating in ports adapted for connection to a source of heated fluid and said storage tank and further being adapted for connection to and support of an expansion tank;

said source heated fluid passage and said first pair of ports providing a heated source loop circuit comprising an inlet connection from said heat source, one of said pumps, said source heated fluid passage, and said expansion tank, and said exchange heated fluid passage and said second pair of ports providing a heated transfer loop circuit comprising an inlet connection for said storage tank, an outlet connection for said storage tank, the other of said pumps, and said exchanger heated fluid passage.

2. The apparatus of claim 1 wherein, one of said elongated members is formed with a third port providing a mounting for a pressure relief valve and being connected to a third passage connecting said pressure relief valve in parallel with said heated source loop circuit.

3. The apparatus of claim 2 wherein, one of said elongated members is formed with a third port providing a mounting for a pressure gauge and being connected to a third passage connecting said gauge in parallel with said heated source loop circuit.

4. The apparatus of claim 3 wherein, said third port is adapted to function as a fill port for said heated source fluid circuited.

5. The apparatus of claim 1 wherein, the other of said elongated members is formed with a third port providing a mounting for a check valve adapted for connection in series in said heated transfer loop circuit to prevent reverse thermosyphoning on cooling of said heated source fluid.

6. The apparatus of claim 5 wherein, said check valve is positioned between said storage tank inlet and said exchange heated fluid passage.

* * * * *